US012662805B2

(12) United States Patent
Chai et al.

(10) Patent No.: US 12,662,805 B2
(45) Date of Patent: Jun. 23, 2026

(54) RAINWATER BIORETENTION FACILITY FOR SYNCHRONIZED NITROGEN AND PHOSPHORUS REMOVAL IN RAINFALL CONDITIONS

(71) Applicant: Chongqing University, Chongqing (CN)

(72) Inventors: Hongxiang Chai, Chongqing (CN); Mengdi Li, Chongqing (CN); Haiyuan Ma, Chongqing (CN); Mengchen Du, Chongqing (CN)

(73) Assignee: CHONGQING UNIVERSITY, Chongqing (CN)

( * ) Notice: Subject to any disclaimer, the term of this patent is extended or adjusted under 35 U.S.C. 154(b) by 68 days.

(21) Appl. No.: 18/943,804

(22) Filed: Nov. 11, 2024

(65) Prior Publication Data

US 2026/0028813 A1 Jan. 29, 2026

(30) Foreign Application Priority Data

Jul. 29, 2024 (CN) ..... 202411021599.7

(51) Int. Cl.
*E03F 1/00* (2006.01)

(52) U.S. Cl.
CPC ..... *E03F 1/002* (2013.01)

(58) Field of Classification Search
CPC . E03F 1/002; E03F 1/00; E03F 5/0404; E03F 5/125; C02F 2103/001; C02F 1/288
See application file for complete search history.

(56) References Cited

U.S. PATENT DOCUMENTS 5,702,593 A * 12/1997 Horsley ..... C02F 3/046 210/170.03
7,776,217 B2 * 8/2010 Lucas ..... C02F 3/327 210/290
8,679,327 B2 * 3/2014 Mellott ..... E03F 5/0404 210/170.03
9,688,544 B2 * 6/2017 Fink ..... C02F 1/00
2007/0256966 A1 * 11/2007 Siviter ..... E03F 5/12 210/170.03
2022/0064024 A1 * 3/2022 Chai ..... C02F 1/281

FOREIGN PATENT DOCUMENTS

CN 216639195 U * 5/2022

* cited by examiner

*Primary Examiner* — Benjamin F Fiorello
(74) *Attorney, Agent, or Firm* — MATTHIAS SCHOLL P.C.; Matthias Scholl

(57) ABSTRACT

A stormwater bioretention facility, including a pool body. The pool body includes an overflow layer, a cover layer, a filtration layer, an upper drainage layer, a biochar layer, a submerged layer, and a lower drainage layer from top to bottom. An upper drainage pipe is disposed in the upper drainage layer; a lower drainage pipe is disposed in the lower drainage layer. The upper drainage pipe and the lower drainage pipe include side walls including a plurality of inlet holes. The lower drainage pipe includes a water outlet raised to be level with the top surface of the submerged layer, and the submerged layer is filled with iron shavings and quartz sand material. The pool body further includes an overflow well having an opening covered by a manhole cover. The water outlets of the upper drainage pipe and the lower drainage pipe are connected to the overflow well.

11 Claims, 1 Drawing Sheet

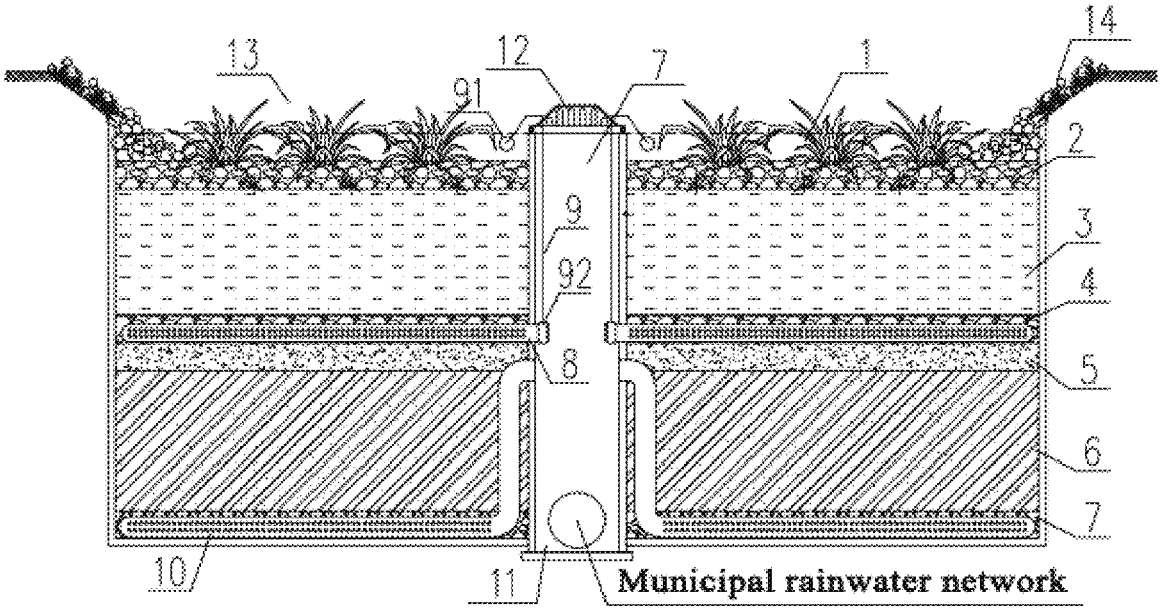
14
13
12
7
1
91
2
9
3
92
4
8
5
6
7
10
11
Municipal rainwater network

RAINWATER BIORETENTION FACILITY FOR SYNCHRONIZED NITROGEN AND PHOSPHORUS REMOVAL IN RAINFALL CONDITIONS

CROSS-REFERENCE TO RELATED APPLICATIONS

Pursuant to 35 U.S.C. § 119 and the Paris Convention Treaty, this application claims foreign priority to Chinese Patent Application No. 202411021599.7 filed Jul. 29, 2024, the contents of which, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, MA 02142.

BACKGROUND

The disclosure relates to the field of sponge city construction, and more particularly to a rainwater bioretention facility for synchronized nitrogen and phosphorus removal in rainfall conditions.

Bioretention facilities have been widely used in watersheds to control runoff pollution. Traditional sand-based bioretention facilities rely on physical processes such as filtration and sedimentation to achieve stable removal of particulate pollutants, but due to their unsuitable structure and single fillers, they are still unable to effectively reduce dissolved pollutants such as ammonium ($NH_4^+$), nitrate ($NO_3^-$), nitrite ($NO_2^-$), ferric iron ($Fe^{3+}$), ferrous ($Fe^{2+}$), sulfate ($SO_4^{2-}$), phosphate ($PO_4^{3-}$), zero-valent iron (ZVI), dissolved oxygen (DO), etc. in stormwater runoff. Existing studies have mainly improved the removal effect of dissolved pollutants in bioretention facilities by two means: structural improvement and substrate improvement.

Structural improvements are usually carried out by raising the height of the outlet pipe to achieve functional division of aerobic and anoxic zones in the facility, to provide suitable growth environments for nitrifying and denitrifying bacteria, and to extend the hydraulic residence time of the facility to optimize the removal of dissolved pollutants. However, there are limitations to structural improvements. Upon encountering heavy rainfall, inadequate drainage capacity can easily lead to flooding of the facility and surrounding parcels, damaging vegetation and creating the risk of flooding. More importantly, stormwater runoff carries a large amount of DO into the submerged zone, which can damage the original anoxic environment and affect the microbial community structure, leading to a significant reduction in the denitrification performance of the facility.

Biochar is a porous material produced by pyrolyzing biomass and includes a variety of active functional groups, thus having a micropolar surface that can adsorb non-polar molecules such as $O_2$ and $CO_2$. In addition, active groups such as environmentally persistent free radicals and phenolic groups on the surface of biochar can react with $O_2$ to reduce the DO content in stormwater runoff. The rich pore structure of biochar not only provides a large number of active sites for adsorption and reaction, but also prevents DO from entering the submerged zone of the facility during dry periods by extending the mass transfer path of gas molecules inside the bioretention facility and increasing the mass transfer resistance, thus effectively protecting the anoxic environment of the submerged zone.

Substrate improvement refers to the addition of functional fillers to the facility. Some studies have achieved rapid adsorption of organic matter and ammonium nitrogen through the addition of highly adsorptive media such as biochar and vermiculite to the facility, or have promoted heterotrophic or autotrophic denitrification to remove nitrate through the addition of organic or inorganic electron donors, such as woodchips or sulfur, and have promoted the flocculation of dissolved phosphorus through the addition of aluminum- or iron-based water treatment residuals. However, most of the fillers can only remove single pollutant; in addition, the addition of solid carbon source has the risk of organic matter leakage and facility blockage, which is easy to cause secondary pollution of the water body and increase the cost of operation and maintenance of the facility. The addition of sulfur will cause a rapid decrease in the pH value of the system and cause intense leaching of sulfate, which affects the growth and metabolism of microorganisms and the oxidation reduction potential of the system, and contributes to the poor performance of the facility's water treatment.

Iron shavings are a type of zero-valent iron, which, as a common industrial by-product, was previously regarded as waste to be directly discarded or landfilled, leading to waste of resources and environmental pollution. Zero-valent iron has a certain electron-supplying capacity and can be involved in the nitrogen cycle driven by microorganisms, and the ferric autotrophic denitrification process has low by-products and no risk of clogging, which makes it possible to be applied in stormwater denitrification treatment. In addition, the $Fe^{2+}$ produced by the dissolution of zero-valent iron can be further oxidized to $Fe^{3+}$, which is conducive to the flocculation and precipitation of dissolved phosphorus in stormwater runoff. Zero-valent iron provides a simpler and more efficient solution than conventional methods. However, in case of large rainfall, DO in the rainwater, as an effective oxidant, reacts with zero-valent iron, resulting in an excessive release of $Fe^{3+}$, which is then rapidly hydrolyzed and precipitated under the circumneutral pH conditions of the rainwater, resulting in the passivation of the surface of the zero-valent iron and the exceeding of the turbidity and chromaticity of the water, which is not conducive to the denitrification process and the treatment of the stormwater.

SUMMARY

The disclosure provides a rainwater bioretention facility for synchronized nitrogen and phosphorus removal in rainfall conditions, to solve the problem of the destruction of the original anoxic environment by DO in stormwater runoff under heavy rainfall and extreme rainfall conditions, thus realizing the effective removal of organic pollutants, dissolved nitrogen, and dissolved phosphorus from stormwater runoff.

The disclosure provides a stormwater bioretention facility, comprising:

- a pool body, the pool body comprising an overflow layer, a cover layer, a filtration layer, an upper drainage layer, a biochar layer, a submerged layer, and a lower drainage layer from top to bottom;
- an upper drainage pipe disposed in the upper drainage layer; and
- a lower drainage pipe disposed in the lower drainage layer; both the upper drainage pipe and the lower drainage pipe comprising side walls comprising a plurality of inlet holes.

The lower drainage pipe comprises a water outlet being raised to be level with a top surface of the submerged layer, and the submerged layer is filled with iron shavings and quartz sand material;

the pool body further comprises an overflow well having an opening covered by a manhole cover; water outlets of the upper drainage pipe and the lower drainage pipe are connected to the overflow well, and an effluent from the overflow well flows into a municipal rainwater network; and the pool body further comprises a water level control valve, configured to control the opening and closing of the water outlet of the upper drainage pipe.

In a class of this embodiment, a 5-10 cm superelevation is disposed between the opening of the overflow well and a top of the pool body; and the manhole cover is a grating or a vertical structure.

In a class of this embodiment, the water level control valve comprises a pilot valve and a main valve; the main valve is disposed at the water outlet of the upper drainage pipe, and the pilot valve is disposed in the overflow layer; the pilot valve is configured to control the opening and closing of the main valve.

In a class of this embodiment, a control water level H of the upper drainage pipe is determined according to the following formula:

$$H = (L - K_u) \times t_p;$$

$K_u$ is an overall infiltration rate of the cover layer and the filtration layer; $t_p$ is a designed waterlogging time; L is a hydraulic loading of the facility, $$L = \frac{Q}{A},$$

where A is an infiltration area of the facility, Q is a designed runoff volume per second, Q=φFq, φ is a weighted runoff coefficient of a catchment area of the facility, F is a service area of the facility, and q is a designed storm intensity, $$q = \frac{167A_1(1 + c\lg P)}{(t + b)^n},$$

P is a designed return period, ranging from 5 to 30 years, t is a rainfall duration, and $A_1$, c, b, and n are local parameters;

a drainability of the overflow well is examined according to the following equation:

$$A_w \times C \times \sqrt{2gh} \times K_w \geq (L - K_b) \times A;$$

$A_w$ is an actual overwater area of the manhole cover, $A_w = n_k \times l \times b_k$, $n_k$ is a number of holes in a width direction, l is a grate hole length, $b_k$ is a grate hole width, C is an orifice coefficient, g is gravitational acceleration, h is a depth of flooding above the opening of the overflow well, $K_w$ is an obstruction coefficient; when calculating L, P is a designed return period, ranging from 30-100 years; and $K_b$ is an overall permeability of the facility.

In a class of this embodiment, the filtration layer comprises biochar material and quartz sand material uniformly mixed and loaded in a volume ratio of 15-25 to 75-85; the biochar material has a particle size from 0 mm to 2 mm; the filtration layer has a height from 30 to 50 cm, and a permeability not less than 200 mm/h.

In a class of this embodiment, the biochar layer comprises biochar material; the biochar material has a particle size from 0 mm to 1 mm; the biochar layer has a height from 5 cm to 10 cm, and a permeability not less than 200 mm/h.

In a class of this embodiment, the biochar material is prepared from agricultural waste comprising hardwood branches and nutshells in a limited oxygen condition through slow pyrolysis at a temperature of 300-600° C. and a heating rate of 0.01-2° C./s.

In a class of this embodiment, the iron shavings and the quartz sand material are mixed in the submerged layer in a volume ratio of 15-25 to 75-85; the submerged layer has a height of 30-40 cm, a permeability not less than 200 m/h, and an overall permeability of the facility ranges from 200-600 mm/h.

In a class of this embodiment, the iron shavings have a depth of 0-2 mm and a width of 1-4 cm.

In a class of this embodiment, the quartz sand material comprises sands having particle size ranges of 10-16 mesh, 26-40 mesh, 40-170 mesh, and 80-120 mesh in a volume ratio of 0-30:15-20:15-20:20-50.

The working principle of the rainwater bioretention facility is summarized as follows:

In case of 1 to 5 years return period rainfall, the upper drainage pipe does not work, rainwater runoff flows through the cover layer, filtration layer, upper drainage layer, biochar layer and submerged layer, and then flows into the overflow well through the lower drainage pipe; in case of 5 to 30 years return period rainfall, the high rainfall inflow makes the overflow layer waterlogged in the middle and late stages of the rainfall. When the water height reaches the control level, the pilot valve installed in the overflow layer will be triggered, and the main valve installed at the outlet of the upper drain pipe will be opened, and at this time, under the action of the water short-circuiting, the rainwater runoff will be filtered through the facility and directly enter the overflow well through the upper drainage pipe, and will no longer flow through the submerged layer; in case of return period rainfall of more than 30 years, the depth of water accumulated in the facility will rapidly reach the top of the overflow well, and the rainwater runoff will not go through the interior of the facility and directly enter the overflow well.

The following advantages are associated with the stormwater bioretention facility of the disclosure.

The stormwater bioretention facility has three water discharging methods: the upper drain outlet, the lower drain outlet and the overflow outlet. The water outlet pathway is automatically adjusted according to the changes of rainwater flowing to the bioretention facility. In case of light and moderate rainfall, rainwater runoff scours the ground surface and carries a large number of pollutants into the filtration layer. After being intercepted and precipitated by the filtration layer and adsorbed by biochar, particulate pollutants, dissolved organic matter, and $NH_4^+$ are effectively removed, and then rainwater enters the submerged layer of the facility. In the meanwhile, the iron shavings are dissolved to produce $Fe^{2+}$ and electrons for nitrogen removal through autotrophic denitrification. The $Fe^{3+}$ formed by the oxidation of $Fe^{2+}$ effectively removes phosphorus through adsorption complexation. Clean rainwater flows into the overflow well through the lower drainage pipe. After the rainfall ends, some residual nitrate nitrogen and dissolved phosphorus will continue to react with iron shavings in the submerged layer.

In case of the heavy rainfall, the rainfall flow path is the same as that of the light and moderate rainfall, and at this time, the biochar layer in the facility is able to cut down the dissolved oxygen (DO) in the rainfall runoff through the physical and chemical adsorption. When the rain stops, the oxygen desorbed from the biochar will diffuse again to the atmosphere, thus achieving the long-term effective protection of anoxic environments of the submerged layer; in case of torrential rain, the effect of the facility matrix on reducing dissolved oxygen in rainwater runoff is very limited. In this case, the concentration of pollutants in rainwater runoff is relatively low, and rainwater flows into overflow well after treatment of particulate pollutants, dissolved organic matter and ammonia nitrogen through the filtration layer.

In case of the extreme rainfall conditions, the stormwater runoff is simply screened out of large particle pollutants by the manhole cover grates and then directly into the overflow well. By adjusting the opening of the upper drainage pipe to control the water level and the height of the overflow well, the facility can be adapted to different conditions of rainfall, thus effectively protecting the submerged layer of the facility, so that the facility can be effective in removing nitrogen and phosphorus, and has a longer service life.

BRIEF DESCRIPTION OF THE DRAWINGS

The sole FIGURE is a schematic diagram of a stormwater bioretention facility in accordance with one embodiment of the disclosure.

DETAILED DESCRIPTION

To further illustrate the disclosure, embodiments detailing a stormwater bioretention facility are described below. It should be noted that the following embodiments are intended to describe and not to limit the disclosure.

As shown in the sole FIGURE, the disclosure provides a rainwater bioretention facility for synchronized nitrogen and phosphorus removal in rainfall conditions, comprising a pool body 13.

The pool body 13 comprises an overflow layer 1, a cover layer 2, a filtration layer 3, an upper drainage layer 4, a biochar layer 5, a submerged layer 6, and a lower drainage layer 7 from top to bottom. An upper drainage pipe 8 disposed in the upper drainage layer 4; a lower drainage pipe 10 disposed in the lower drainage layer 7; both the upper drainage pipe 8 and the lower drainage pipe 10 comprising side walls comprising a plurality of inlet holes. The lower drainage pipe 10 comprises a water outlet being raised to be level with a top surface of the submerged layer 6.

As shown in the sole FIGURE, the pool body 13 further comprises an overflow well 11. The overflow well 11 is constructed at the lowest elevation of the cover layer 2 according to the actual situation. The height of the opening of the overflow well 11 is set according to local rainfall conditions, and the height difference between the opening and the cover layer 2 is the height of the overflow layer 1. The height between the opening and the top of the pool body 13 is 5-10 cm. The opening is covered by a manhole cover 12; the manhole cover 12 is a grate or is of a façade design to prevent accumulation of leaves, floating garbage, and other foreign matter at the mouth of the well during a rainstorm. The water outlets of the upper drainage pipe 8 and the lower drainage pipe 10 are connected to the overflow well 11, and an effluent from the overflow well 11 flows into a municipal rainwater network.

As shown in the sole FIGURE, the pool body 13 further comprises a water level control valve 9; the water level control valve 9 comprises a pilot valve 91 and a main valve 92; the main valve 92 is disposed at the water outlet of the upper drainage pipe 8, and the pilot valve 91 is disposed in the overflow layer 1; the pilot valve 91 is configured to control the opening and closing of the main valve 92.

As shown in the sole FIGURE, there is a grass and stone buffer zone 14 around the pool body 13, which aims to reduce the flow rate of rainwater runoff, disperse the flow of rainwater runoff, and intercept large foreign objects, thereby reducing the erosion and damage of rainwater runoff to the pool body 13 and preventing the blockage of the pool body 13 caused by the accumulation of large foreign objects, and extending the service life of the facility. To ensure stability, the slope of the grass stone buffer zone 14 is less than 1:3 and naturally connects with the facilities and surrounding greenery.

The control water level H of the upper drainage pipe 8 is determined as follows:

First, the designed runoff volume per second Q is determined based on local rainfall conditions, and the calculation formula is: $Q=\varphi Fq$, $\varphi$ is a weighted runoff coefficient of a catchment area of the facility, F is a service area of the facility, and q is a designed storm intensity, $$q = \frac{167A_1(1 + c\lg P)}{(t + b)^n},$$

P is a designed return period, t is a rainfall duration, and $A_1$, c, b, and n are local parameters;

second, determine the control water level H of the upper drainage pipe 8 and the height of the overflow layer 1 according to the design runoff. When calculating H, Q should be the minimum runoff volume generated by the catchment area when rainwater flows out of the upper drainage pipe 8, and P ranges from 5 to 30 years; when calculating the height of the overflow layer 1, Q should be the maximum runoff volume generated by all catchment areas in the catchment area participating in the runoff, and P is the designed return period, and ranges from 30 to 100 years.

The hydraulic loading L of the facility is calculated according to the formula $$L = \frac{Q}{A}$$

for different designed runoff rates, where A is an infiltration area of the facility.

The control water level H is determined according to the following formula:

$$H = (L - K_u) \times t_p;$$

$K_u$ is an overall infiltration rate of the cover layer 2 and the filtration layer 3, which can be obtained after preselecting the filler type and filler ratio of the facility; $t_p$ is a designed waterlogging time. Taking the 1-hour rainfall that occurs once every 10 years in Chongqing as an example, assuming that the catchment area is 20 times the facility area, the comprehensive runoff coefficient of the catchment area is selected as 0.7, the overall permeability of the cover layer 2 and filtration layer 3 is 300 mm/h, and the water accumulation time is 10 minutes, the calculated hydraulic loading of the facility is 628.03 $mm^3/mm^2 \cdot h$, the controlled water level is 117.47 mm, and 120 mm is taken. The height $H_w$ of the overflow layer 1 should be calculated according to the formula $H_w \geq (L-K_u) \times t_p$, and the value should be within the range of 10-30 cm.

In this embodiment, the overflow well 11 is constructed with bricks, and the opening adopts a vertical single grate inlet. For specific implementation, the selection of the overflow well 11 and the opening can refer to the national standard atlas 16S518 "Rainwater Inlet", and the opening size can be verified according to the formula $$A_w \times C \times \sqrt{2gh} \times K_w \geq (L - K_b) \times A,\ A_w$$

is an actual overwater area of the manhole cover 12, $A_w = n_k \times l \times b_k$, $n_k$ is a number of holes in a width direction, l is a grate hole length, $b_k$ is a grate hole width, C is an orifice coefficient, when the grate hole is rounded, the C value is 0.6, and when the grate hole is square, the C value is 0.8; g is gravitational acceleration, which is 9.8 $m^2/s$, h is a depth of flooding above the opening of the overflow well, $K_w$ is an obstruction coefficient; and $K_b$ is an overall permeability of the facility.

The substrate for the cover layer 2 is gravel with a particle size of 1-3 cm, and the height of the cover layer 2 is 5-10 cm, to protect the facility structure, prevent low-density substrates such as biochar and quartz sand from being washed out with the water flow, and intercept large particle pollutants in rainwater runoff to reduce the risk of facility blockage. In actual use, materials such as pebbles, gravel, wood chips, etc. with a particle size of 1-3 cm are also practicable.

The filtration layer 3 comprises biochar and quartz sand materials, uniformly mixed and loaded in a volume ratio of 15-25:75-85. The biochar has a particle size range of 0-2 mm, and the quartz sand contains four particle size ranges: 10 mesh-16 mesh, 26 mesh-40 mesh, 40 mesh-170 mesh, and 80 mesh-120 mesh, and is uniformly mixed at a volume ratio of 20-30:20-30:20-30:20-30. The height of the filtration layer 3 is 30-50 cm, and the permeability should not be less than 200 mm/h.

The filtration layer 3 is planted with drought-resistant, flood-resistant, root-developed plants to increase the effect of pollutant removal and to meet the landscape requirements, preferably, native plants; planting density can be appropriately increased compared to the conventional planting density to increase the greening area and enhance the ornamental properties.

The biochar layer 5 contains biochar material; the biochar particle size ranges from 0 mm to 1 mm. The height of the biochar layer 5 is 5 cm to 10 cm, and the permeability should not be less than 200 mm/h.

The raw material used for the biochar layer is agricultural waste such as hardwood branches and nut shells, and the preparation conditions are slow pyrolysis temperature increase rate 0.01° C./s-2° C./s in a nitrogen atmosphere at a temperature of 300-600° C.

The submerged layer 6 contains iron shavings and quartz sand material, uniformly mixed and loaded in a volume ratio of 15-25:75-85. The iron shavings have a thickness range of 0-2 mm and a width range of 1-4 cm, and the quartz sand comprises four particle size ranges: 10 mesh-16 mesh, 26 mesh-40 mesh, 40 mesh-170 mesh, and 80 mesh-120 mesh, and is uniformly mixed at a volume ratio of 0-30:15-20:15-20:20-50. The height of the submerged layer 6 is 30-40 cm and the permeability should not be less than 200 mm/h.

The substrate of the upper drainage layer 4 and the lower drainage layer 7 is gravel with a particle size of 1-2 cm, to prevent the collapse of biochar, quartz sand and other substrates leading to structural damage to the facility and drain clogging, the height of the upper drainage layer 4 and the lower drainage layer 7 are 5-15 cm.

The overall permeability of the facility should be 200-600 mm/h, which ensures the water transmission ability and achieves a better removal effect of pollutants in rainwater runoff.

The working principle of the stormwater bioretention facility is summarized as follows:

In case of light and moderate rainfall, stormwater runoff washes over the ground surface and carries a large number of pollutants into the facility, and at the moment the hydraulic loading of the facility is less than the overall infiltration rate of the facility, and water does not accumulate in the overflow layer 1. Rainwater runoff into the facility first flows through the cover layer 2, and the gravel, pebbles and other fillers in the cover layer 2 can effectively retain large particles of pollutants.

During the above mentioned light and moderate rainfall, the rainwater flows into the filtration layer 3 through the cover layer 2, and the small particle size quartz sand and biochar filler in the filtration layer 3 can filter the small particles of pollutants, and at the same time, the cationic adsorption capacity of the biochar makes it able to quickly adsorb the dissolved organic pollutants and ammonia nitrogen carried by the rainwater, and the biochar is also able to release the appropriate amount of nutrients to support the growth of the plants and the rapid development of microorganisms, and the porous structure of the biochar is also conducive to microbial colonization. Under the synergistic effect of biochar adsorption, plant transformation and microbial transformation, organic pollutants and ammonia nitrogen in stormwater runoff can be effectively removed by the filtration layer.

During the above mentioned light and moderate rainfall, the rainwater flows into the submerged layer 6 after passing through the cover layer 2, the filtration layer 3, the upper drainage layer 4, and the biochar layer 5, and the submerged layer 6 is in a long term submerged state and features a good denitrification environment because the outlet of the lower drainage pipe 10 is higher than the top of the submerged layer 6. At this time, the iron shavings continue to supply electrons and remove nitrate-nitrogen through the iron autotrophic denitrification process mediated by microorganisms, and meanwhile, dissolved $Fe^{3+}$ of iron shavings can also effectively remove phosphorus through adsorption complexation. Ultimately, the treated clean rainwater is discharged into the overflow well 11 through the lower drainage pipe 10.

In case of heavy rainfall, the hydraulic loading of the facility is greater than the overall infiltration rate of the facility and the overflow layer 1 begins to be flooded. After the designed ponding time $t_p$, the concentration of pollutants in the confluent stormwater runoff is low, at which time the water depth of the overflow layer 1 reaches the control level, and the pilot valve 91 installed in the overflow layer 1 is triggered, controlling the main valve 92 installed in the upper drain 8 to open. The particulate pollutants, dissolved organics, and ammonia and nitrogen are removed through the filtration layer 3, and then the water flows from the upper drainage pipe 8 directly into the overflow well 11 in the water short-circuiting effect. As the reduction effect of facility matrix on DO of rainwater runoff is very limited during rainstorm, to protect the anoxic environment of the submerged layer 6, rainwater runoff no longer passes through the submerged layer 6.

In extreme rainfall conditions, the hydraulic loading of the facility is much greater than the overall permeability of the facility, and the water accumulates quickly in the overflow layer 1. The facility needs to quickly drain water to prevent plant root rot and water accumulation in the road caused by rainwater accumulation. At this time, the accumulated water in the overflow layer 1 that is higher than the opening of the overflow well 11 flows directly into overflow well 11 after being screened for large particle pollutants by the manhole cover 12. The water below the opening is treated by the filtration layer 3 and then flows to the overflow well 11 through the upper drainage pipe 8.

When the depth of the accumulated water in the overflow layer 1 is lower than the control water level, the pilot valve 91 drives the main valve 92 of the upper drainage pipe 9 to close, and the facility is restored to discharge water through the lower drainage pipe 10.

Definitions about rainfall intensity of the disclosure are as follows:

| Rainfall intensity | 24-hour Rainfall Totals (mm) |
|---|---|
| Light | 0.1-9.9 |
| Moderate | 10-24.9 |
| Heavy | 25-49.9 |
| Very heavy | 50-99.9 |
| Intense | 100-250 |
| Extreme | >250 |

It will be obvious to those skilled in the art that changes and modifications may be made, and therefore, the aim in the appended claims is to cover all such changes and modifications.

What is claimed is:

1. A stormwater bioretention facility, comprising:

a pool body, the pool body comprising an overflow layer, a cover layer, a filtration layer, an upper drainage layer, a biochar layer, a submerged layer, and a lower drainage layer from top to bottom;

an upper drainage pipe disposed in the upper drainage layer; and a lower drainage pipe disposed in the lower drainage layer; both the upper drainage pipe and the lower drainage pipe comprising side walls comprising a plurality of inlet holes;

wherein:

the lower drainage pipe comprises a water outlet being raised to be level with a top surface of the submerged layer, and the submerged layer is filled with iron shavings and quartz sand material;

the pool body further comprises an overflow well having an opening covered by a manhole cover; water outlets of the upper drainage pipe and the lower drainage pipe are connected to the overflow well, and an effluent from the overflow well flows into a municipal rainwater network;

the pool body further comprises a water level control valve, configured to control the opening and closing of the water outlet of the upper drainage pipe;

a control water level H of the upper drainage pipe is determined according to the following formula:

$$H = (L - K_u) \times t_p;$$

$K_u$ is an overall infiltration rate of the cover layer and the filtration layer; $t_p$ is a designed waterlogging time; L is a hydraulic loading of the facility, $$L = \frac{Q}{A},$$

where A is an infiltration area of the facility, Q is a designed runoff volume per second, Q=φFq, φ is a weighted runoff coefficient of a catchment area of the facility, F is a service area of the facility, and q is a designed storm intensity, $$q = \frac{167A_1(1 + c\lg P)}{(t + b)^n},$$

P is a designed return period, ranging from 5 to 30 years, t is a rainfall duration, and $A_1$, c, b, and n are local parameters;

a drainability of the overflow well is examined according to the following equation:

$$A_w \times C \times \sqrt{2gh} \times K_w \geq (L - K_b) \times A;$$

$A_w$ is an actual overwater area of the manhole cover, $A_w = n_k \times l \times b_k$, $n_k$ is a number of holes in a width direction, l is a grate hole length, $b_k$ is a grate hole width, C is an orifice coefficient, g is gravitational acceleration, h is a depth of flooding above the opening of the overflow well, $K_w$ is an obstruction coefficient; when calculating L, P is a designed return period, ranging from 30-100 years; and $K_b$ is an overall permeability of the facility.

2. The stormwater bioretention facility of claim 1, wherein a 5-10 cm superelevation is disposed between the opening of the overflow well and a top of the pool body; and the manhole cover is a grating or a vertical structure.

3. The stormwater bioretention facility of claim 1, wherein the water level control valve comprises a pilot valve and a main valve; the main valve is disposed at the water outlet of the upper drainage pipe, and the pilot valve is disposed in the overflow layer; the pilot valve is configured to control the opening and closing of the main valve.

4. The stormwater bioretention facility of claim 1, wherein the filtration layer comprises biochar material and quartz sand material uniformly mixed and loaded in a volume ratio of 15-25 to 75-85; the biochar material has a particle size from 0 mm to 2 mm; the filtration layer has a height from 30 to 50 cm, and a permeability not less than 200 mm/h.

5. The stormwater bioretention facility of claim 4, wherein the biochar material is prepared from agricultural waste comprising hardwood branches and nutshells in a limited oxygen condition through slow pyrolysis at a temperature of 300-600° C. and a heating rate of 0.01-2° C./s.

6. The stormwater bioretention facility of claim 4, wherein the quartz sand material comprises sands having particle size ranges of 10-16 mesh, 26-40 mesh, 40-170 mesh, and 80-120 mesh in a volume ratio of 20-30:20-30:20-30:20-30.

7. The stormwater bioretention facility of claim 1, wherein the biochar layer comprises biochar material; the biochar material has a particle size from 0 mm to 1 mm; the biochar layer has a height from 5 cm to 10 cm, and a permeability not less than 200 mm/h.

8. The stormwater bioretention facility of claim 7, wherein the biochar material is prepared from agricultural waste comprising hardwood branches and nutshells in a limited oxygen condition through slow pyrolysis at a temperature of 300-600° C. and a heating rate of 0.01-2° C./s.

9. The stormwater bioretention facility of claim 1, wherein the iron shavings and the quartz sand material are mixed in the submerged layer in a volume ratio of 15-25 to 75-85; the submerged layer has a height of 30-40 cm, a permeability not less than 200 m/h, and an overall permeability of the facility ranges from 200-600 mm/h.

10. The stormwater bioretention facility of claim 9, wherein the iron shavings have a depth of 0-2 mm and a width of 1-4 cm.

11. The stormwater bioretention facility of claim 9, wherein the quartz sand material comprises sands having particle size ranges of 10-16 mesh, 26-40 mesh, 40-170 mesh, and 80-120 mesh in a volume ratio of 0-30:15-20:15-20:20-50.

* * * * *